United States Patent [19]

Töpfer

[11] Patent Number: 4,922,882

[45] Date of Patent: May 8, 1990

[54] CRANKCASE VENTILATION SYSTEM

[75] Inventor: Walter Töpfer, Iptingen, Fed. Rep. of Germany

[73] Assignee: Dr. Ing. h.c.f. Porsche AG, Fed. Rep. of Germany

[21] Appl. No.: 379,967

[22] Filed: Jul. 14, 1989

[30] Foreign Application Priority Data

Jul. 21, 1988 [DE] Fed. Rep. of Germany ..... 3824791

[51] Int. Cl.[5] ..... F02M 25/06

[52] U.S. Cl. ..... 123/572; 123/556

[58] Field of Search ..... 123/572, 574, 556

[56] References Cited

U.S. PATENT DOCUMENTS

| | | | |
|---|---|---|---|
| 2,281,124 | 4/1942 | Westcott | 123/572 |
| 2,489,230 | 11/1949 | Winkler | 123/572 |
| 3,116,727 | 1/1964 | Dietrich | 123/572 |
| 3,364,910 | 1/1968 | Hulse | 123/572 |
| 3,381,673 | 5/1968 | Drysdale | 123/572 |
| 3,500,806 | 3/1970 | Sarto et al. | 123/556 |
| 4,102,314 | 7/1978 | Sarto | 123/572 |

FOREIGN PATENT DOCUMENTS 2949096 5/1983 Fed. Rep. of Germany .

*Primary Examiner*—Willis R. Wolfe
*Assistant Examiner*—M. Macy
*Attorney, Agent, or Firm*—Evenson, Wands, Edwards, Lenahan & McKeown

[57] ABSTRACT

A ring-shaped duct, which is connected to a coolant circulating system, extends in a throttle valve housing in an air intake section of an internal-combustion engine. A ventilating pipe for the crankcase gases is connected to the throttle valve housing, is divided into branches in the throttle valve housing and leads into ventilating points in front of and behind the throttle valve. The coolant, which circulates in the ring-shaped duct, simultaneously prevents an icing of the throttle valve and of the ventilating points.

10 Claims, 1 Drawing Sheet

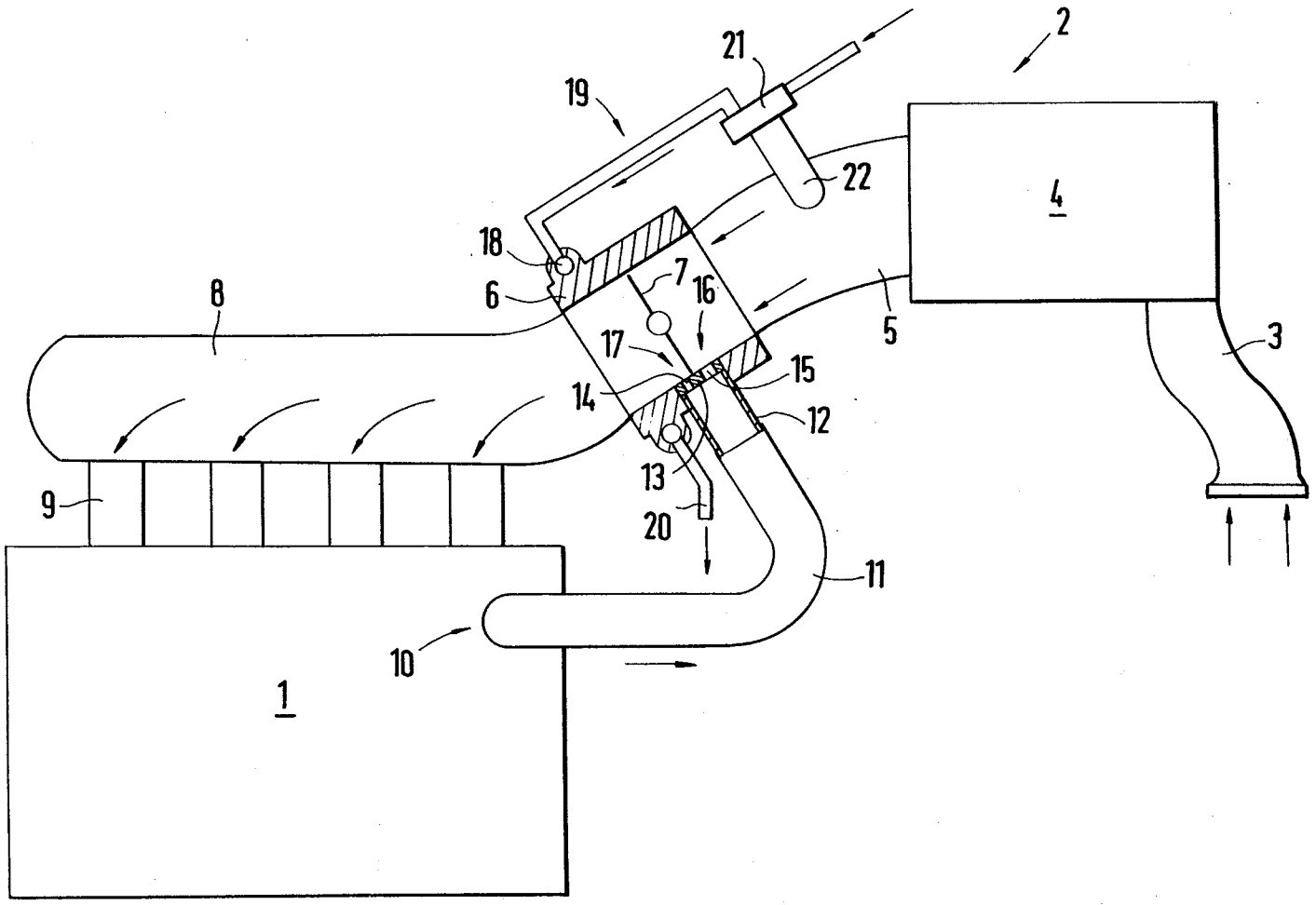
2
3
4
5
6
7
8
9
10
11
12
13
14
15
16
17
18
19
20
21
22
1

CRANKCASE VENTILATION SYSTEM

BACKGROUND AND SUMMARY OF THE INVENTION

The invention relates to a crankcase ventilation system for an internal-combustion engine, having a main ventilating point arranged in a throttle valve housing and leading into the intake air flow in front of a throttle valve, with a secondary ventilating point arranged behind the throttle valve, and having a ventilating point arranged behind the throttle valve, and having a ventilating point arranged from the internal-combustion engine into a throttle valve housing with the throttle valve housing being connected to a coolant circulating system and being heated by it.

Crankcase ventilation systems are known, for example, from U.S. Pat. No. 3,364,910, in which a pipe leading out of the crankcase branches into two pipes which then lead to a main ventilating point located in front of a throttle valve and to a secondary ventilating point located behind the throttle valve. Therefore a total of three separate pipes are required in this case. An icing of both ventilating points, for example, as a result of freezing condensation water is not prevented. In the case of an icing, the crankcase can therefore not be ventilated. This is against the legal requirements and results in leaks, for example, at crankshaft sealing rings as a result of the resulting excess crankcase pressure.

A throttle valve, the icing of which is prevented by a ring duct through which cooling water flows and which extends in the throttle valve housing, is known from DE-PS No. 29 49 096.

It is an object of the present invention to provide a crankshaft ventilation system which, in a simple manner ventilates the crankcase into the air intake section during the normal load operation as well as in the coasting or idling operation of the internal-combustion engine, and in which an icing of the ventilating points in the air intake section is prevented.

According to the invention, this object is achieved by providing a system wherein the ventilating pipe inside the throttle valve housing branches into a duct leading to the main ventilating point and a duct leading to the secondary ventilating point.

The particular advantages of the invention are that the ventilating of the crankcase is achieved in all positions of the throttle valve in a simple manner, and that by arranging a ring duct through which the coolant flows in direct proximity of the throttle valve and the ventilating points, an icing of these points and of the throttle valve is prevented. In addition, only one line, which is usually constructed as a hose, is required for the feeding of the crankcase, and costs are reduced as well as the expenditures for the assembly and service. In addition, the throttle valve housing can be manufactured in one piece with all connections according to certain preferred embodiments.

Other objects, advantages and novel features of the present invention will become apparent from the following detailed description of the invention when considered in conjunction with the accompanying drawings

BRIEF DESCRIPTION OF THE DRAWINGS

The single drawing FIGURE schematically shows a construction of a crankcase ventilation system on an internal-combustion engine constructed in accordance with a preferred embodiment of the invention.

DETAILED DESCRIPTION OF THE DRAWINGS

An internal-combustion engine 1 is supplied with fresh air through an air intake section 2. The internal-combustion engine first conveys the fresh air through an intake piece 3 and an air filter 4. From the air filter 4, the fresh air flows through a pipe piece 5 and then through a throttle valve housing 6, in which an adjustable throttle valve 7 is arranged. Subsequently, the fresh air flows into an air collector or intake manifold and from there through suction pipes 9 into the combustion chambers of the internal-combustion engine 1. The internal-combustion engine 1 has a crankcase ventilating point 10, from which a ventilating pipe 11 leads to the throttle valve housing 6 and is fastened there at a connecting piece 12. The end of the connecting piece 12, which is located inside the throttle valve housing 6, is closed by a disk 13. The disk 13 has two ducts 14, 15 which penetrate it, duct 15 leading into the main ventilating point 16 and duct 14 leading into the secondary ventilating point 17. The main ventilating point 16 is located upstream in front of the throttle valve 7; the secondary ventilating point 17 is located downstream behind the throttle valve 7. The duct 14 and the secondary ventilating point 17 have a clearly smaller cross-sectional surface than the duct 15 and the main ventilating point 16.

In the normal load operation of the internal-combustion engine 1, the throttle valve 7 is open. The air flowing through the air intake section 2 has a lower pressure than the gases in the crankcase of the internal-combustion engine 1. This pressure difference conveys the crankcase gases through the ventilating pipe 11 from the internal-combustion engine 1 to the throttle valve housing 6. As a result of the larger cross-sectional surface of the main ventilating point 16, the crankcase gases flow predominantly through this ventilating point 16 into the air intake section 2 and are mixed there with the fresh air which flows in after them and are supplied to the internal-combustion engine 1. The cross-sectional surfaces of the ducts 14 and 15 are dimensioned such that the occurring volume of crankcase gase can be discharged reliably.

When the internal-combustion engine 1 is operated in the coasting or idling operation, the throttle valve housing 6 is shut by the throttle valve 7 which is disposed transversely to the flow direction of the intake air. In this case, the throttle valve 7 separates the main ventilating point 16 from the secondary ventilating point 17. Since the internal-combustion engine 1 continues to try to convey fresh air through the air intake section 2, and the throttle valve 7 closes the air intake section 2, a strong vacuum is generated in the part of the air intake section 2 which is located downstream of the throttle valve 7. This vacuum sucks the crankcase gases through the duct 14 to the secondary ventilating point 17. The discharge surface of the secondary ventilating point 17 clearly has smaller dimensions than that of the main ventilating point 16, because the amount of crankcase gases occurring in the coasting or idling operation is correspondingly low.

In the throttle valve housing 6, a ring-shaped duct 18 is arranged which is disposed concentrically with respect to the throttle valve 7 and extends at a narrow distance from the connecting piece 12 and the ducts 14, 15. By way of an inlet 19 and an outlet 20, this duct is connected to the cooling water circulating system of the internal-combustion engine 1. Since the danger that the throttle valve 7 may ice up exists only at corresponding outside air temperatures, a thermostatic valve 21, which, together with an air temperature sensor 22, is inserted into the pipe piece 5 of the suction section 2, controls the coolant inflow as a function and within certain limits of the intake air temperature. Advantageously, by means of the arrangement of the ventilating points 16, 17 in proximity of the duct 18, the icing of these ventilating points 16, 17 is also prevented. Ducts 14, 15 can be inexpensively provided in the disk 13 in the form of bores.

As an alternative, the connecting piece 12 can be manufactured in one piece with the disk 13 as a cast part. In order to reduce mounting expenditures, in a further embodiment of the invention, the connecting piece may be manufactured in one piece with the throttle valve housing 6 and the disk 13 as a cast part.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A crankcase ventilation system for an internal-combustion engine, having a main ventilating point arranged in a throttle valve housing and leading into the intake air flow in front of a throttle valve, having a secondary ventilating point arranged behind the throttle valve, and having a ventilating pipe leading from the internal-combustion engine into a throttle valve housing, the throttle valve housing being connected to a coolant circulating system and being heated by it, wherein the ventilating pipe, inside the throttle valve housing, branches into a duct leading to the main ventilating point and a duct leading to the secondary ventilating point 2. A crankcase ventilation system according to claim 1, wherein a ring-shaped duct is arranged in the throttle valve housing, this ring-shaped duct being connected to the coolant circulating system and extending in proximity of the connecting piece and of the two ventilating points.

3. A crankcase ventilation system according to claim 2, wherein the ventilating pipe is connected to a connecting piece inserted radially into the throttle valve housing, and in that the connecting piece, at its end located in the throttle valve housing, is closed off by a circular bottom, in which the duct leading to the main ventilating point as well as the duct leading to the secondary ventilating point are disposed.

4. A crankcase ventilation system according to claim 2, wherein the coolant inlet is controlled as a function of the intake air temperature by a thermostatic valve which is inserted into it and which, together with an air temperature sensor, is inserted into the air intake section.

5. A crankcase ventilation system according to claim 3, wherein the bottom is constructed as a circular disk which is connected with the connecting piece.

6. A crankcase ventilation system according to claim 3, wherein the connecting piece is constructed in one piece with the bottom as a cast part.

7. A crankcase ventilation system according to claim 3, wherein the throttle valve housing is constructed in one piece with the connecting piece and with the bottom as a cast part.

8. A crankcase ventilation system according to claim 5, wherein the ducts are constructed as bores.

9. A crankcase ventilation system according to claim 6, wherein the ducts are constructed as bores.

10. A crankcase ventilation system according to claim 7, wherein the ducts are constructed as bores.

* * * * *